US007721776B2

(12) United States Patent
Justin

(10) Patent No.: US 7,721,776 B2
(45) Date of Patent: May 25, 2010

(54) TILES AND APPARATUS, SYSTEM AND METHOD FOR FABRICATING TILES AND TILE PATTERNS

(76) Inventor: Louis K. Justin, 10778 W. Braemar Dr., Holly, MI (US) 48442

( * ) Notice: Subject to any disclaimer, the term of this patent is extended or adjusted under 35 U.S.C. 154(b) by 1104 days.

(21) Appl. No.: 11/274,986

(22) Filed: Nov. 16, 2005

(65) Prior Publication Data

US 2006/0102252 A1 May 18, 2006

Related U.S. Application Data

(60) Provisional application No. 60/628,426, filed on Nov. 16, 2004.

(51) Int. Cl.
*B27C 5/00* (2006.01)

(52) U.S. Cl. ..... 144/144.51; 144/145.1; 144/286.5; 33/562

(58) Field of Classification Search ..... 144/137, 144/144.1, 144.51, 145.1, 136.95, 286.1, 144/286.5; 33/562, 566; 409/125, 126, 130
See application file for complete search history.

(56) References Cited

U.S. PATENT DOCUMENTS

| | | | | | |
|---|---|---|---|---|---|
| 99,201 | A | * | 1/1870 | Jenkins | 144/144.51 |
| 143,835 | A | | 10/1873 | Muller | |
| 174,212 | A | * | 2/1876 | Doane | 144/144.51 |
| 613,333 | A | | 11/1898 | Thomas | |
| 799,681 | A | | 9/1905 | Sloan | |
| 928,320 | A | | 7/1909 | Moore | |
| 4,063,736 | A | | 12/1977 | Robinson | |
| 4,133,152 | A | | 1/1979 | Penrose | |
| 4,217,740 | A | | 8/1980 | Assanti | |
| 4,223,890 | A | | 9/1980 | Schoen | |
| 4,230,164 | A | * | 10/1980 | Mericle | 144/372 |
| 4,319,615 | A | * | 3/1982 | Ditmanson | 144/144.1 |
| 4,350,341 | A | | 9/1982 | Wallace | |
| 4,353,672 | A | * | 10/1982 | Smith | 409/97 |
| 5,040,581 | A | | 8/1991 | Takashima | |
| 5,114,265 | A | | 5/1992 | Grisley | |
| 5,249,614 | A | | 10/1993 | Osborn | |
| D346,337 | S | | 4/1994 | Carey | |
| 5,383,503 | A | * | 1/1995 | Johnson | 144/144.51 |

(Continued)

OTHER PUBLICATIONS

M.C. Escher, The Mathematical Art of M.C. Escher, Platonic Realms Mini Texts, www.mathacademy.com, May 24, 2004, pp. 1-8.

(Continued)

*Primary Examiner*—Shelley Self
(74) *Attorney, Agent, or Firm*—Brooks Kushman P.C.

(57) ABSTRACT

A router template for fabricating a contoured tile from a workpiece is provided. The router template includes a body that defines a cavity in which a nest is formed for retaining a workpiece during a cutting operation. A bearing path is defined within the body that engages a bearing of the router bit to guide the workpiece relative to the router bit. A cutting path is formed within the body to provide clearance within the body for a rotary cutting portion of the router bit. The cutting path and bearing path are aligned with each other and correspond to the desired size and contour of the tile. A method of cutting a contoured tile by following a template is also disclosed.

4 Claims, 12 Drawing Sheets

U.S. PATENT DOCUMENTS

| | | | | |
|---|---|---|---|---|
| 5,520,388 | A | 5/1996 | Osborn | |
| 5,697,413 | A | 12/1997 | Fuller | |
| 5,868,188 | A | 2/1999 | Fukuda | |
| 5,945,181 | A | 8/1999 | Fisher | |
| 5,967,209 | A | 10/1999 | Fukuda | |
| 6,293,322 | B1 * | 9/2001 | Wilson-South | 144/372 |
| 6,309,716 | B1 | 10/2001 | Fisher et al. | |
| 6,568,442 | B1 | 5/2003 | Meugniot | |

OTHER PUBLICATIONS

Douglas Dunham, Transformation of Hyperbolic Escher Patterns, www.d.umn.edu, May 24, 2004.
Tessellation, www.mathworld.wolfram.com, May 24, 2004, pp. 1-5.
Tessellations and Quadtrees, www.snork.hom.texas.net, May 24, 2004, pp. 1-5.
Triangular Symmetry Group, www.mathworld.wolfram.com, May 24, 2004, pp. 1-2.
Dimorphic, www.tess-elation.co.uk, May 24, 2004, p. 1.
Polyhedral Solids, www.home.teleport.com, May 24, 2004, p. 1-2.
Parquet Deformations, www.tess-elation.co.uk, May 24, 2004, p. 1-4.
Lee Valley & Veritus®, Mar. 2004, pp. 1-5.
Fractals by Jos Leys, Hyperbolic Tilings, www.josleys.com, May 24, 2004, p. 1-6.
Escher and the Droste Effect, www.escherdrost.math.leidenuniv.nl, May 24, 2004.
M.C. Escher, The Official Website, www.mcescher.com, May 24, 2004.
Antiques Roadshow, Antiques Speak, www.pbs.org, Aug. 20, 2004, p. 1-2.
Gecko Stone™, Put some life under your feet!, www.geckostone.com, Jul. 26, 2004.
Pat Warner, Template Routing Basics, Jul./Aug. 1997, pp. 48-52.
Bill Ewing, Fine Woodworking, Sep./Oct. 1999, pp. 76-80.

* cited by examiner

TILES AND APPARATUS, SYSTEM AND METHOD FOR FABRICATING TILES AND TILE PATTERNS

CROSS-REFERENCE TO RELATED APPLICATIONS

This application claims the benefit of U.S. provisional application Ser. No. 60/628,426, filed Nov. 16, 2004.

BACKGROUND OF THE INVENTION

1. Field of the Invention

The invention relates to tiles, more particularly to tiles and apparatuses, systems and methods for fabricating tiles and tile patterns.

2. Background Art

Conventionally tiles are utilized on floors, walls, furniture or the like to provide an ornamental surface. Often, when tiles are utilized on surfaces such as floors or furniture tops, these surfaces experience pedestrian traffic or wear from objects placed thereupon.

Conventional flooring patterns include simplified patterns and complex patterns. The simplified patterns include wooden flooring and tiles of a uniform polygonal shape, such as rectangular tiles. Neither of which require, nor are provided with, limited tolerances. Minimal gaps are permissible in wood flooring because they generally do not upset the aesthetic appearance of the flooring and the gaps flow in the direction of the flooring and the associated grain patterns. If undesired, such gaps are typically filled with a mixture of sawdust and adhesive that is stained to match the associated flooring. Conventional simplified tiles do not require limited tolerances, because they are generally fabricated from a ceramic, stone or similar material that requires spacing between adjacent tiles and a grout or tile adhesive disposed therebetween. Therefore, variances in tolerances are unnoticed because adjacent tiles do not actually mate with one another.

Conventional semi-complicated tile patterns are typically limited to basic geometric shapes, such as lines, circle arcs and the like, and are limited in tolerances as well. Ceramic or stone tiles are conventionally spaced to receive grouting or tile adhesive therebetween and therefore the lack of precision is unnoticed. In complex wooden tile patterns, such as tiling, flooring, inlays, borders, parquetry and marquetry, tolerances are lacking thereby generating visually noticeable gaps between adjacent tiles. These conventional complex wooden tile patterns are costly and labor intensive and any gaps exacerbate these difficulties by requiring filling in the gaps. The filling is a combination of sawdust and a wood adhesive or lacquer which is stained to create nebulous feature lines. Another difficulty presented in wood tiling is that wooden tiles have a tendency to change shape and size due to humidity, drying, application of finishing materials, or the like. Therefore, when wooden tiles are fabricated by a manufacturer to specific tolerances, these tolerances may change by the time the tiles have gone through channels of distribution and finally reach the user who subsequently installs the tiles.

Other manufacturing methods include waterjet cutting or laser cutting. Such methods are typically unavailable to general public consumers. These methods are also ineffective for some tile materials. Waterjet cutting can not hold a good tolerance in most applications, (e.g., plus or minus 0.015 inches for most materials). Additionally, wood tends to absorb water thereby swelling and resulting in an inaccurately cut tile. Laser cutting can provide a tighter tolerance but is dependent on the refractive index of the materials and the thickness of the material being cut. Wood has a poor refractive index, thereby resulting in an imprecisely cut tile.

Conventional jigs for woodworking are typically limited in scope, functionality, application, quality and tolerance thereby limiting these characteristics of the resultant workpiece. Additionally, conventional woodworking jigs are limited in range of variations and styles. A woodworker must select from a predetermined variety of jigs to machine a workpiece.

Many tile patterns comprise various geometrical shapes, which are derived from mathematics. Mathematically developed patterns known as tessellations are geometric patterns formed by congruent plane figures of one or more types. Tessellations include infinite tessellations, finite tessellations and metamorphosis tessellations. Infinite tessellations also known as two dimensional tessellations because they represent a planar geometry upon a planar surface and are generally derived from Euclidean mathematics. Finite tessellations, also known as three-dimensional tessellations, provide a representation of a three dimensional object illustrated upon a two dimensional surface. Finite tessellations are derived from Euclidian mathematics or non-Euclidean mathematics, such as hyperbolic mathematics, spherical mathematics, or the like. Finite tessellations illustrate, for example, a representation of an infinite tessellation formed about a sphere, yet represented as projected upon a two dimensional planar surface. Tessellations are appreciated by both mathematicians and artists and are commonly associated with the artistry of M. C. Escher.

Due to the complexity of tessellations, they are generally only found in artwork, engravings, prints, posters or the like. Difficulties in reducing tessellated patterns into interlocking tiles is apparent in the prior art. For example, artwork of M. C. Escher has been embodied by tiles such as the glazed tiles in the column at the New Girls' School, in the Hague, circa 1959 and the Tile Mural (First) Liberal Christian Lycum, the Hague, circa 1960. Both of these tile representations do not include a single tile for each geometrical representation. Rather, the geometrical pattern is formed upon conventional rectangular tiles and individual geometrical units are separated by grouted gaps in between adjacent tiles. The prior art has further evolved by providing concrete molds for generating tessellated paver stones that are generally interlocking; however, gaps are provided between adjacent stones as well.

SUMMARY OF THE INVENTION

According to one aspect of the present invention, a router template for fabricating a tile from a workpiece in a rotary cutting operation of a router having a router bit is provided. The router template comprises a body having a nest formed within the body for retaining the workpiece during the cutting operation. A bearing path is formed within the body for engaging a bearing of the router bit and guiding the workpiece relative to the router bit. The bearing path is sized and contoured to correspond to the desired size and contour of the tile. A cutting path is formed within the body for providing clearance within the body for a rotary cutting portion of the router bit. The cutting path is aligned with the bearing path so that the rotary cutting portion of the router bit cuts the workpiece as the bearing follows the bearing path.

According to another aspect of the invention, a template for moving a workpiece on a table top router as the workpiece is cut to form a contoured product is provided. The router has a bit that is assembled coaxially with a bearing. The template is utilized to cut tiles of a desired shape. The template comprises a body defining a cavity and a nest for retaining the workpiece within the cavity. Means are provided for guiding movement of the template as the workpiece retained in the cavity is moved into engagement with the router bit of the table top router to form the contoured product to the desired shape.

According to another aspect of the invention, a method of cutting a contoured tile by following a template with a table top router having a cutting blade and a bearing is provided. The template is used to guide movement of the workpiece blank in accordance with the method wherein the workpiece blank is inserted into a nest defined within the template. The template is placed on the table top router with the cutting blade of the router disposed within a cutting clearance groove and spaced from the workpiece blank. The template is moved to cause the bearing to engage the bearing path surface formed within the guide body. The bearing traces the bearing path that is patterned after the shape of the contoured tile. The workpiece is cut with the cutting blade as the cutting blade is moved within a clearance groove that is formed within the guide body as the bearing traces the bearing path to form the contoured tile.

According to another aspect of the present invention, a gage may be formed on the body of the router template that may be used to set up the router bit to the proper height prior to performing the cutting operation.

According to other aspects of the invention, the template may be formed to tolerances sufficient to produce tiles that interlock with one another. The template is formed to tolerances that are sufficient to produce tiles of a tessellation pattern. Alternatively stated, the template is formed to tolerances sufficient to produce tiles that mate with one another with minimal gaps, such as gaps that are within ±0.0001 inches.

According to additional aspects of the present invention, the nest may further comprise a recess within the body that is sized to receive the workpiece. The nest may further comprise side walls for retaining the workpiece laterally.

According to other aspects of the invention, the body may comprise a contact surface for engaging a router table from which the router bit extends and is driven rotationally during the cutting operation. The body is manually translated on the contact surface relative to the router bit. The nest may further comprise a recess formed within the body that is sized to receive the workpiece within the nest. The recess may in part comprise a platen that is oriented generally parallel to the contact surface of the body.

According to another aspect of the invention, the bearing path and the cutter path may be stacked in a direction normal to the contact surface.

According to still further aspects of the invention, a window may be formed through the body that opens into a surface that faces in the opposite direction from the contact surface for viewing the cutting operation. The window may further be defined as a viewing slot that is aligned with the cutting path.

According to yet another aspect of the present invention, the router template may comprise a retaining mechanism for retaining the workpiece within the nest. The retaining mechanism may be oriented laterally inboard relative to the cutting path for retaining the workpiece during and after the cutting operation. The retaining mechanism may further be defined as comprising a plurality of pins, such as precision locating pins, that pierce the workpiece to retain the workpiece in the lateral direction. At least one aperture may be formed through the nest for ejecting the workpiece from the nest.

These and other aspects of the present invention will be better understood in view of the attached drawings and the following detailed description of the illustrated embodiments.

DETAILED DESCRIPTION OF THE PREFERRED EMBODIMENT(S)

With reference to FIGS. 1 to 4, a preferred embodiment jig is illustrated in accordance with the teachings of the present invention. The jig is embodied as a router template and is referenced generally by numeral 100. The template 100 utilized for receiving and retaining a workpiece 102, which is illustrated in phantom in FIG. 1. The template 100 is adapted to cooperate with a conventional router table for routing the workpiece 102 for fabricating a finished tile 104. A wooden workpiece 102 is illustrated, however, the invention contemplates any tile material such as ceramic, stone, polymer, composite, formica or the like. The template 100 enables a novice woodworker, with minimal tools, to create precision geometric or tessellated patterns in wood and other materials. The template 100 may be formed from a machined piece of stock, such as aluminum or steel, or machined from an aluminum, steel or alloy casting, or injection molded from a high strength plastic material. The template 100 may be coated with a low friction material, or laminated to reduce friction between the template and the router table.

The template 100 has a footprint larger than the workpiece 102 to stabilize the template 100 upon a router table, or alternatively to stabilize a manually operated router upon the template 100. This stabilization maintains a perpendicular relationship of an associated router bit with the template 100.

Figure 1:
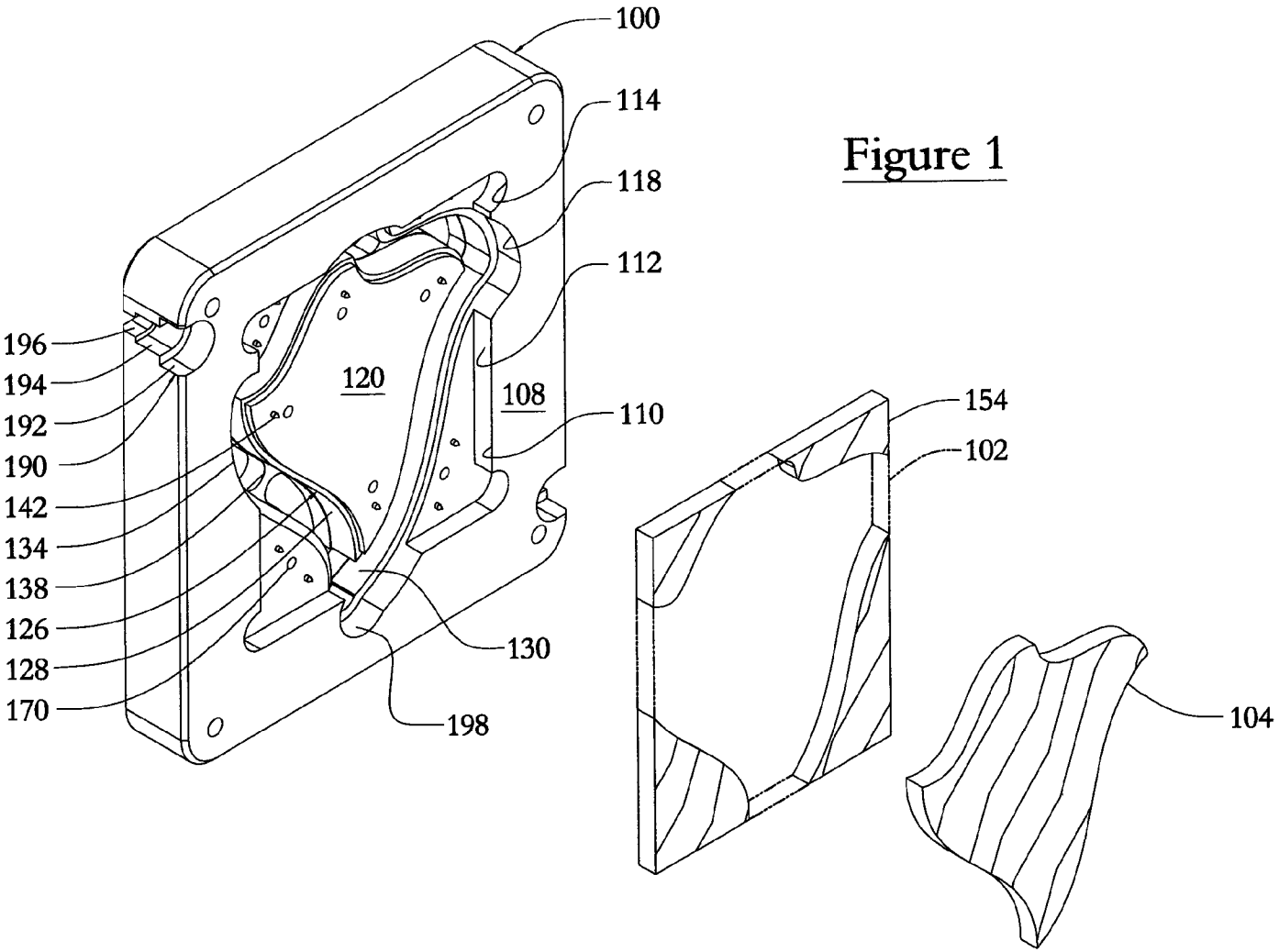
FIG. 1 is a perspective view of a preferred embodiment router template in accordance with the present invention, the router template is illustrated with an associated workpiece and a finished tile.
Figure 2:
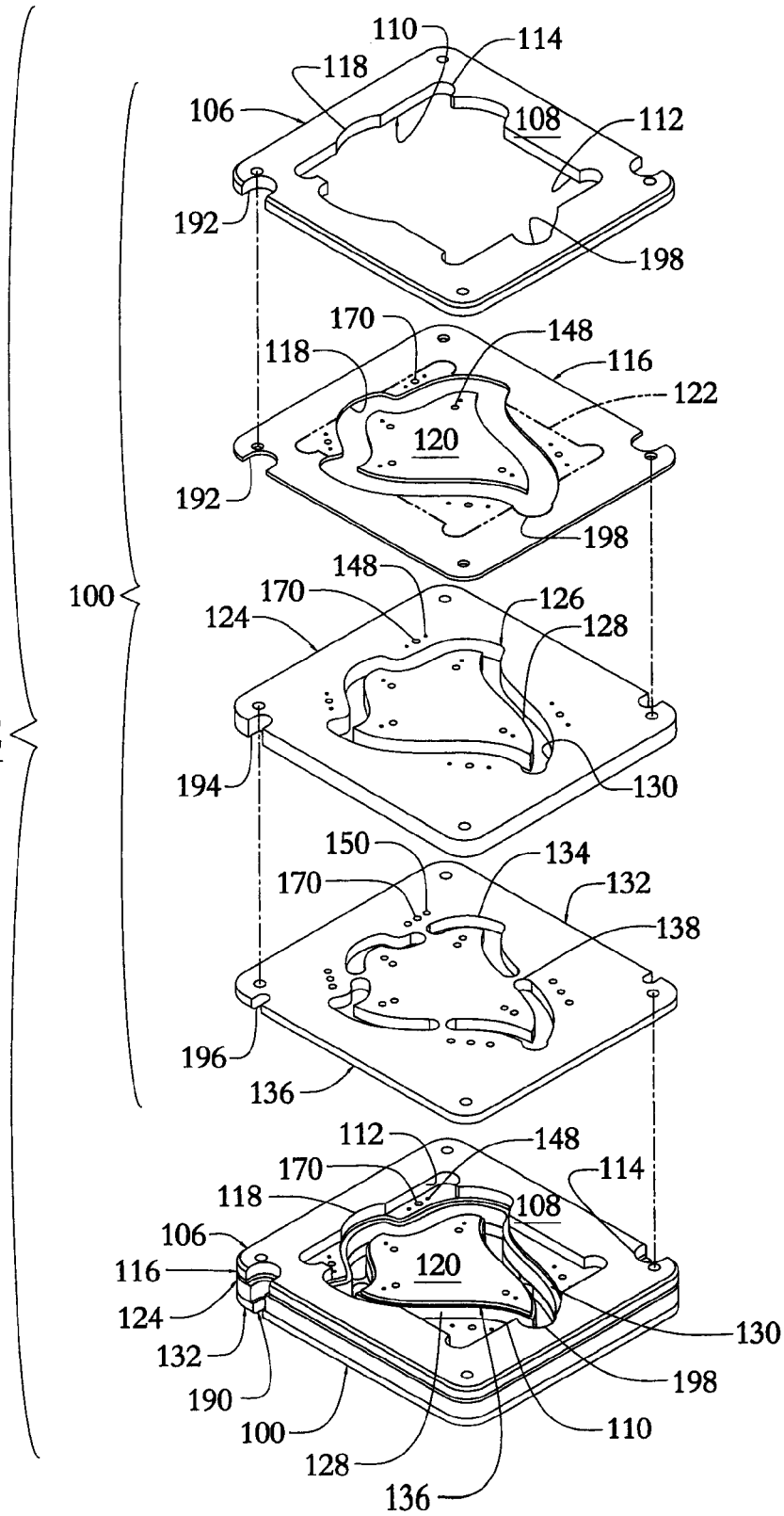
FIG. 2 is a perspective view of the router template of FIG. 1, and an exploded perspective view of the router template of FIG. 1.

Referring specifically to FIG. 2, the template 100 is illustrated exploded into four general layers, which comprise the template 100. FIG. 2 also illustrates the template 100 with cutting lines imbued thereon representing the planes of separation illustrated in the exploded layers. The first layer 106 includes a bottom surface 108 of the template, which acts as a sliding surface for cooperating with the router table and sliding thereupon. Additionally, the bottom surface 108 may provide a support surface to a hand held router. The first layer 106 includes a base cavity 110. The base cavity 110 includes a workpiece nest 112 for retaining the workpiece lengthwise and widthwise within the template 100. Since the workpiece 102 is rectangular in shape, the workpiece nest 112 is generally rectangular in shape as well, and includes cutouts 114 at each of the corners of the workpiece 102 to provide ease and placement of the workpiece 102 within the nest 112. The nest 112 retains the workpiece 102 laterally and acts as a rough two-way locator for accepting a rough cut workpiece 102.

A second template layer 116 includes a cutter path 118 formed therein. The cutter path 118 matches the silhouette of the tile 104 and is sized to provide clearance to a router cutting bit. The cutter path 118 defines a platen 120 of the nest 112 for receiving the workpiece 102 in the direction of the stock thickness for retaining the workpiece 102 within the template 100 and maintaining the workpiece 102 flattened parallel to the bottom surface 108 of the template 100 and the associated router table or router. The platen 120 has a silhouette that is undersized relative to the finished tile 104 to provide clearance to the cutter in operation. Additionally, the cutter path 118 provides an overall clearance to the cutter to prevent a cutting edge of the router bit to contact the template 100, thereby preventing damage to the router bit, router and template 100. Additionally, the cutter path 118 allows cut debris to flow away from the associated cutter bit. The cutter path 118 is also formed through the first layer 106 and therefore forms part of the base cavity 110. Portions of the second layer 116, that are outboard of the cutter path 118 and within the nest 112, form part of the platen 120 and are illustrated within a platen perimeter 122 that is illustrated in phantom in FIG. 2.

The template 100 includes a third layer 124, which includes a bearing path 126 formed therethrough. The bearing path 126 is aligned with the cutter path 118. The bearing path 126 is a high precision slot for receiving a router bearing for guiding the template relative to the router cutting bit, or the router relative to the template 100, so that a precision router cutting operation is performed on the workpiece 102. The bearing path 126 provides minimal, exacting precision clearance for the router bearing. Since the tile 104 is oriented inboard relative to the bearing path 126, it is desired that the user maintain the router bearing against the inboard lateral portion 128 of the bearing path 126 thereby providing clearance externally above the router bit. In the alternative, if the tile 104 were oriented externally of the bearing path 126, it would be desired to maintain the routing bearing against an external lateral region 130 of the bearing path 126 while maintaining the clearance internally relative to the router bearing. This practice provides an accurate tile 104 that is cut relative to the bearing path 126. Additionally, the bearing path 126 assists in the flow of air and debris through the template 100.

The template 100 includes a fourth layer 132. The inboard bearing path region 128 and the platen 120 center extend therefrom and the outboard bearing path region 130 extends therefrom thereby providing a unitary template 100. The fourth layer 132 includes a series of slots 134 formed therethrough. The slots 134 collectively provide a window opening through the template 100, which is viewable from a top surface 136 of the template 100. The slots 134 are generally aligned with the bearing path 126 and the cutter path 118. The slots 134 do not encompass the entire perimeter of the tile 104 to provide a series of webs 138 for maintaining regions of the template 100 that are both inboard and outboard of the cutter path as the unitary apparatus. The slots 134 permit visual access to the cutter bit and the workpiece 102 during the cutting operation. The width of the slots 134 is less than the router cutter bearing diameter to restrict access of the cutter bit from the operator during operation. Additionally, the slots 134 permit flow of air and debris through the template 100. Conventional routers typically force air along the router bit thereby removing debris from the cutting operation. The template 100 collectively provides openings through the four layers 106, 116, 124 and 132 for assisting in this flow of forced air and for permitting debris removal from the cutting operation. Alternatively, the top surface 136 could be closed and attached to a vacuum system for removing and filtering debris from the cutting operation.

Of course, any number of functional layers is contemplated within the spirit and scope of the present invention. The template embodiment 100 illustrated includes preferred layers utilized in the fabrication of the tile 104.

Figure 3A:
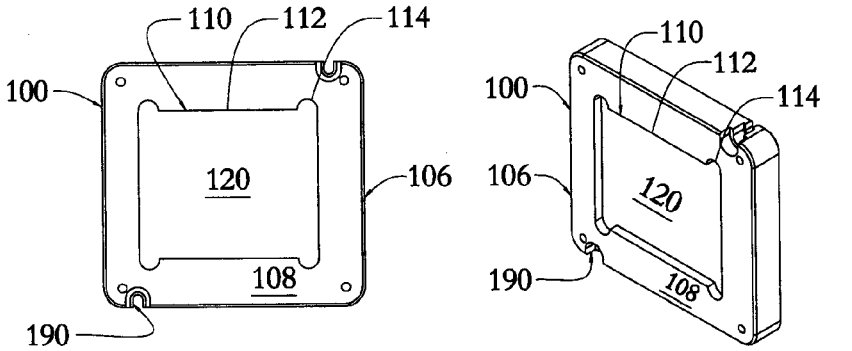
FIG. 3*a* is a bottom plan view and a perspective view of the router template of FIG. 1, illustrated after a manufacturing step thereof.
Figure 3B:
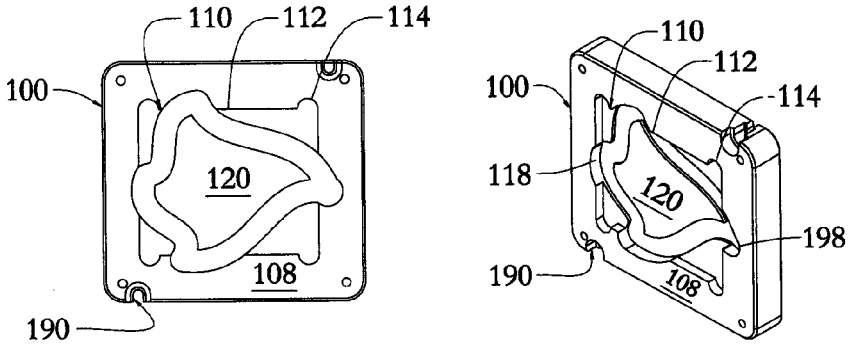
FIG. 3*b* is a bottom plan view and a perspective view of the router template of FIG. 1, illustrated after another manufacturing step thereof.
Figure 3C:
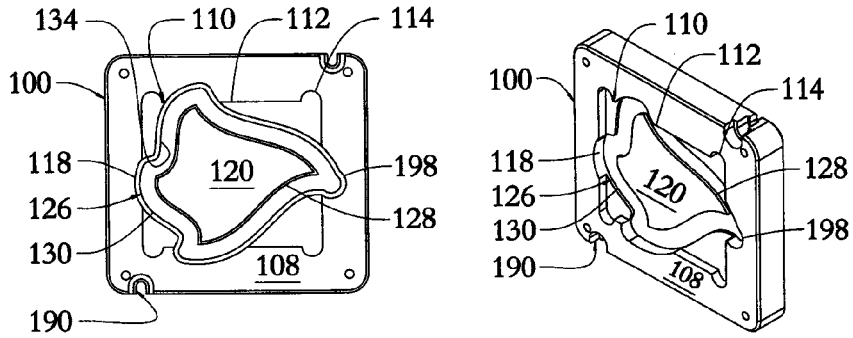
FIG. 3*c* is a bottom plan view and a perspective view of the router template of FIG. 1, illustrated after another manufacturing step thereof.
Figure 3D:
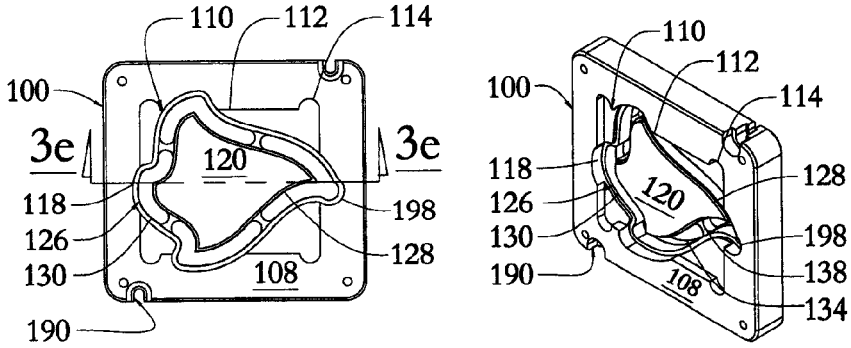
FIG. 3*d* is a bottom plan view and a perspective view of the router template of FIG. 1, illustrated after yet another manufacturing step thereof.
Figure 3E:
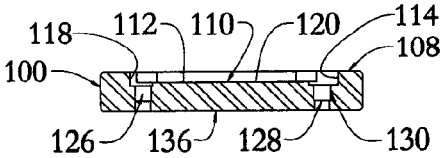
FIG. 3*e* is a section view of the router template of FIG. 1 taken along section line 3*e*-3*e* from FIG. 3*d;*

With reference now to FIGS. 3*a* to 3*e*, manufacturing steps for the template 100 are illustrated. FIG. 3*d* illustrates the template 100 with all four layers 106, 116, 124 and 132, and FIG. 3*e* is a section view across the template 100. The following manufacturing steps refer to machining operations, which may be performed from a mill or a Computer Numerical Control (CNC) machine upon a blank stock piece, a casting or the like. Of course, the invention contemplates that each of these steps may be performed concurrently through a plastic injection molding process. In reference to the following manufacturing steps, the invention contemplates that these steps may be performed in any order, however the below description follows the flow from the first layer 106 through the fourth layer 132.

Referring now to FIG. 3*a*, the template 100 is provided with a flat bottom surface 108, which can be provided from a flat stock piece, or machined into a stock piece or casting.

Referring now to FIGS. 3*a* to 3*d*, the router template 100 is illustrated after incremental manufacturing steps have been performed thereto. Each of these manufacturing steps, for a preferred embodiment of the router template 100, are performed by a CNC machine. Referring now to FIG. 3*a*, the base cavity 110 is machined into the jig thereby providing the workpiece nest 112 and cutouts 114. The base cavity 110 is cut to a depth thereby providing a platen 120 within the base cavity 110.

With reference now to FIG. 3*b*, a subsequent step machines the cutter path 118 into the router template 100. The cutter path 118 is cut to a depth that is deeper than that of the platen 120, which is also illustrated in FIG. 3*e*. The cutter path 118 intersects the base cavity 110 thereby providing the platen 120 in a shape similar to the finished workpiece 102, however having a greater overall width extending slightly inward from the finished workpiece 102.

FIG. 3*c* illustrates the next manufacturing step, the machining of the bearing path 126. As illustrated in FIGS. 3*c* and 3*e*, the bearing path 126 is generally aligned with the cutter clearance path 118. However, the bearing path 126 has a narrower slot width and is formed deeper in the router template 100 than the cutter path 118.

Referring now to FIGS. 3*d* and 3*e*, the next manufacturing step comprises machining of the slots 134, which collectively provide a window for viewing the cutting operation within the router template 100 from the top surface 136 of the router template 100. The slots 134 are not continuous to provide webs 138 which interconnect the platen 120 with the remainder of the router template 100. The slots 134 are formed in a depth of the router template 100 that is greater than that of the bearing path 126. The slots 134 each have a slot width that is less than that of the bearing path 126 to prevent an associated cutter from extending into the bearing path 126, in the instance that the cutter depth may be inadvertently set to an improper dimension.

Although the steps listed above are in a sequence for manufacturing the preferred router template 100, any series and sequence of steps is contemplated within the spirit and scope of the present invention.

Figure 4:
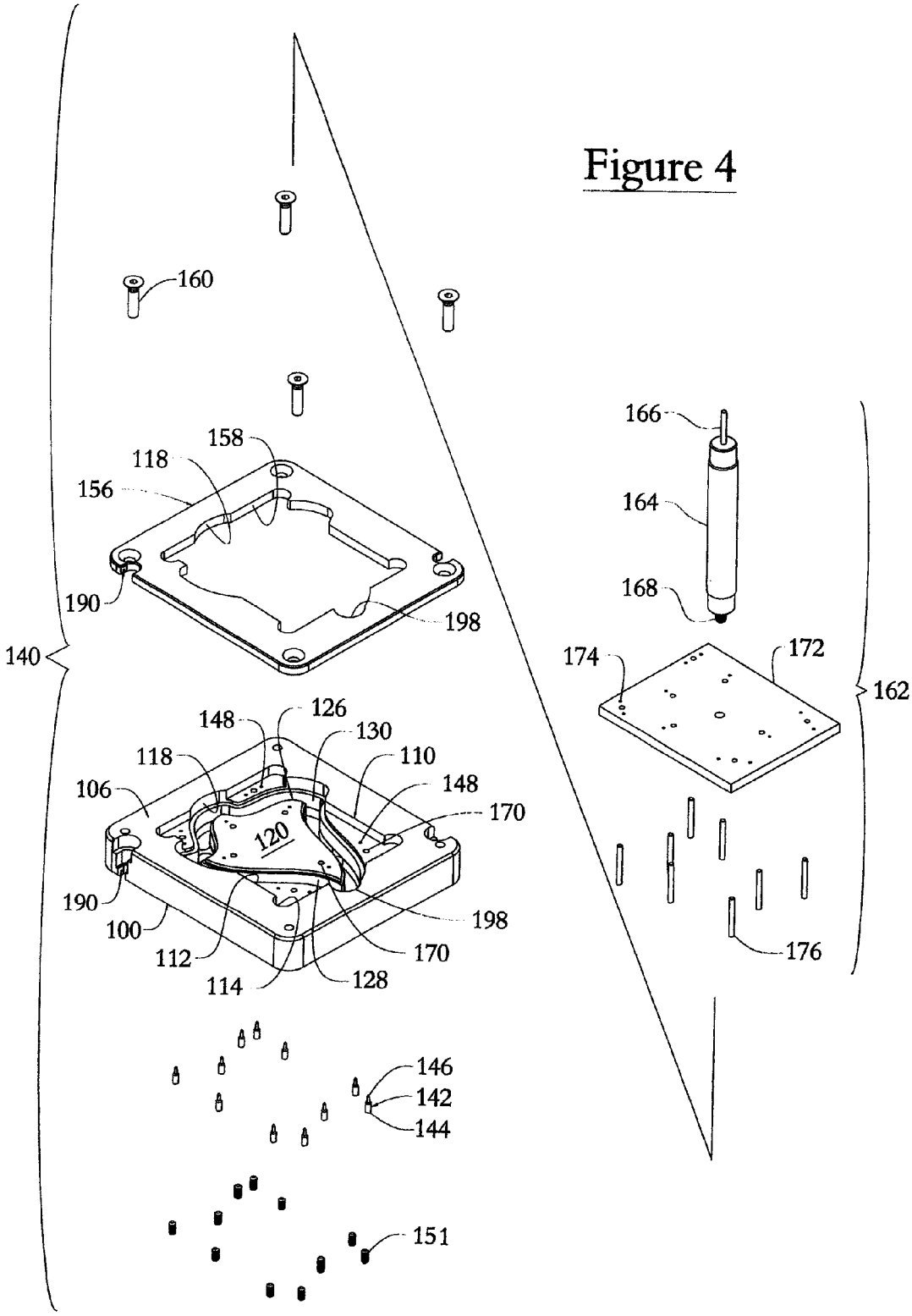
FIG. 4 is an exploded perspective view of a router template assembly and a hand tool for use therewith, the router template assembly includes the router template of FIG. 1.

With reference now to FIG. 4, a router template assembly 140 is illustrated in accordance with the teachings of the present invention. The router template assembly 140 includes the router template 100. The router template 100 includes a retaining mechanism for retaining the workpiece 102, and subsequently the tile 104, within the workpiece nest 112 during the cutting operation. The retaining mechanism of a preferred embodiment router template 100 is a plurality of retaining pins 142 for rigid and precise two-way locating. The retaining pins 142 assure two-way location and minimize displacement during router operation. The retaining pins 142 allow a workpiece 102 to be reinserted into the template 100 if required.

To maintain finite accuracy two operations could be performed, a rough cutting operation, and a finish cutting operation. The advantage to this process is to optimize cutter performance. An old worn cutter bit can be used for rough operation to cut the basic shape. A new sharp cutter bit can be used to cut the pattern to ensure dimension stability between parts and lengthen cutter life, since only minimal material will be cut. The invention contemplates router templates that are used for cutting basic non-tessellated shapes and holes, which utilize brad nails that are hammered in from the top of the template through a non precision access hole in the template to hold the workpiece during operation.

Figure 9:
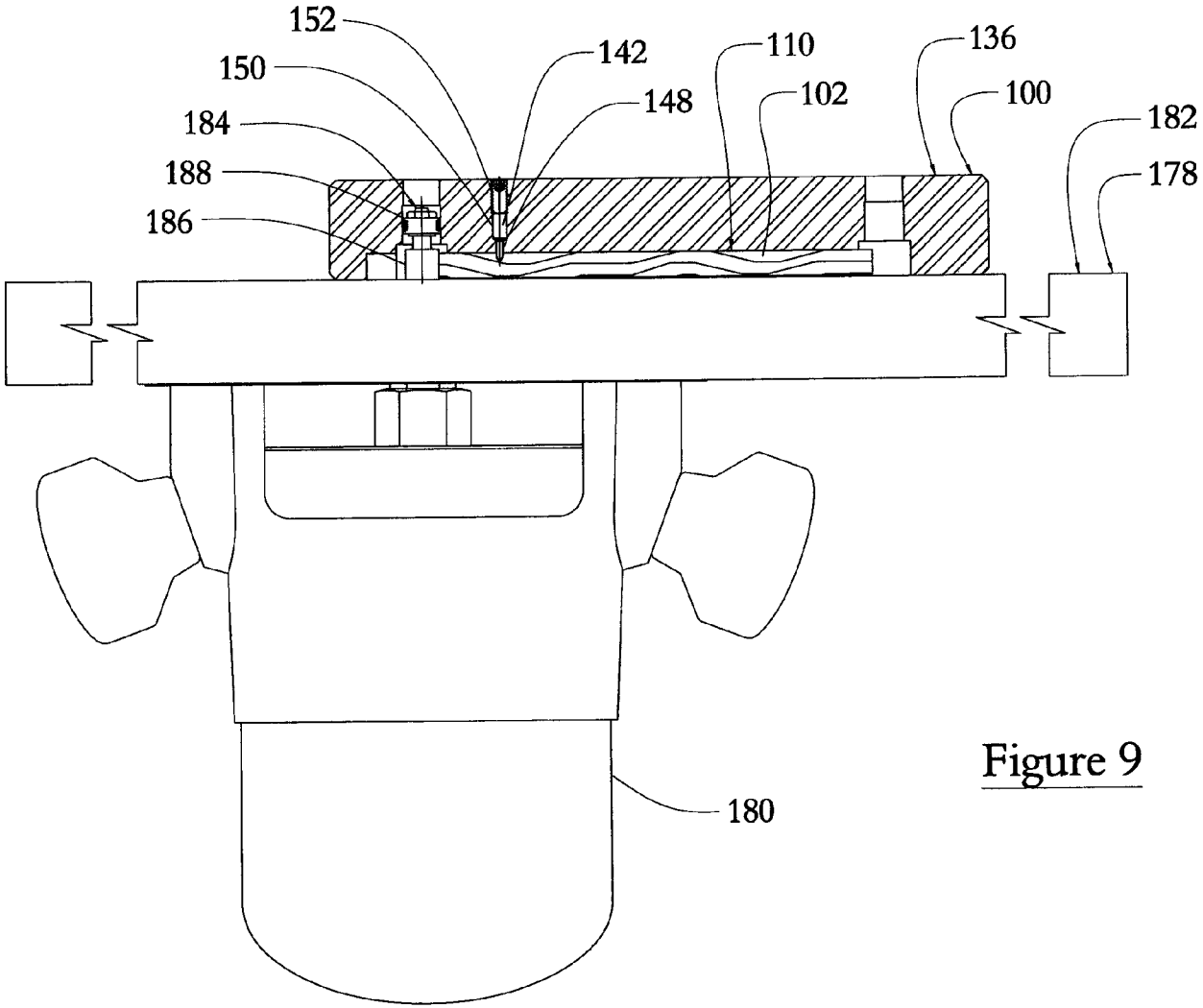
FIG. 9 is a partial section side view of the router template and router table of FIG. 5, illustrated during the cutting operation.

With reference to FIG. 4 and FIG. 9, each retaining pin 142 includes a body portion 144 and a pin end 146 that is narrower than the body 144 and extends therefrom. Each pin end 146 extends through an aperture 148 formed through the platen 120. Each pin body 144 is received within an enlarged pin body bore 150, which is enlarged relative to the pin aperture 148 and is coaxially aligned therewith for receiving the pin body 144. A series of set screws 151 are each received within a threaded region 152 coaxially aligned with the bore 150 for securing the retaining pins 142 within the router template 100.

Referring again, specifically to FIG. 4, the retaining pins 142 are assembled into the router template 100 to extend into the base cavity 110. When a workpiece 102 is introduced into the workpiece nest 112, the pins 142 pierce the underside of the workpiece 102 and retain the workpiece 102 and subsequently the tile 104 and associated scrap pieces 154 during the cutting operation.

Each retaining pin 142 is formed of a tool steel that is hardened subsequent to machining. The hardening process is preferably performed by cryogenically freezing the pins 142. The retaining pins 142 are removable from the router template 100 for replacement due to wear or fatigue. Although retaining pins 142 are illustrated and described, any retaining mechanism is contemplated within the spirit and scope of the present invention. For example, the workpiece 102 could be retained by a vacuum, an adhesive or the like.

With reference again to FIG. 4, the router template assembly 140 is illustrated with an optional spacer 156. The workpiece nest 112 includes a nominal depth for a nominal thickness workpiece 102; for example one-quarter inch stock. The spacer 156 includes an aperture 158 formed therethrough having a matching profile with the workpiece nest 112. The spacer 156 is fastened to the router template 100 by a plurality of fasteners 160. The spacer 156 has a nominal thickness for permitting use of the router template assembly 140 with a workpiece 102 having a thickness greater than that of the workpiece nest 112. For example, spacer 156 could have a thickness of one quarter inch for utilization with half inch stock. Of course, the invention contemplates that the router template assembly 140 may be provided with a series of spacers 156, each having an incrementally increasing thickness for utilization of the assembly 140 with a plurality of workpiece 102 thicknesses. For example, an optional spacer could be provided for three quarter inch stock and one inch stock as well.

Referring to FIG. 4, a multi-purpose hand tool 162 is illustrated for utilization with the router template assembly 140. The hand tool 162 includes a handle 164 with an ejection pin 166 extending from one end and a threaded rod 168 extending from the other end. A user may grasp the handle 164 and utilize the hand tool 162 for inserting the ejection pin 166 into one of a series of ejection bores 170 that are formed through the platen 120 of the router template 100, generally approximate to one of the pin apertures 148. Each pin end 146 has a length less than the thickness of the associated workpiece 102 to avoid burrs or imperfections imparted upon the front or finished surface of the resulting tile 104. Subsequent to the woodworking operation, the resulting tile 104 and scrap pieces 154 are retained within the workpiece nest 112 due to the cooperation with the retaining pins 142. Therefore, the user may eject the tile 104 and scrap pieces 154 by inserting the ejection pin 166 into each ejection bore 170 from the top surface 136 to thereby remove these pieces from the router template 100.

The hand tool 162 includes a gauge plate 172 threadably connected to the threaded rod 168. The gauge plate 172 has a length, width and thickness that matches the workpiece 102 for utilization as a gauge that can be used with other power tools, such as a table saw for cutting stock into workpieces 102 sized for the router template 100.

The gauge plate 172 includes a plurality of pin straightening apertures 174 each formed to the gauge plate 172. The pin straightening apertures 174 are counter-sunk on the bottom surface (not shown). When the retaining pins 142 experience wear to an extent wherein pin ends 146 become bent, the gauge plate 172 may be inserted into the workpiece nest 112 as illustrated in the guiding lines in FIG. 4 so that each pin end 146 is inserted into a corresponding pin straightening apertures 174 thereby realigning any misaligned pin ends 146. Of course, the retaining pins 142 are hardened to an optimal hardness to ensure long life and minimal deflection during operation.

The hand tool 162 includes a plurality of ejection pins 176 each affixed to and extending from the gauge plate 172. The ejection pins 176 are arranged so that the user may grasp the handle 164 and insert the ejection pins 176 into the ejection bores 170 to eject the tile 104 and scrap pieces 154 in one ejection motion. If a workpiece material is selected that is not easily insertable into the workpiece nest 112, due to interference with the retaining pins 142, or is not easily removable via ejection from the workpiece nest 112, a user may utilize a mallet or the like for inserting the workpiece 102 into the workpiece nest 112 and for ejecting the workpiece 102 from the workpiece nest 112. The arrangement of the ejection pins 176 is symmetrical so that the ejection pins 176 are received into the ejection bores 170 when the gauge plate 172 is being utilized for straightening the retaining pins 142.

Figure 5:
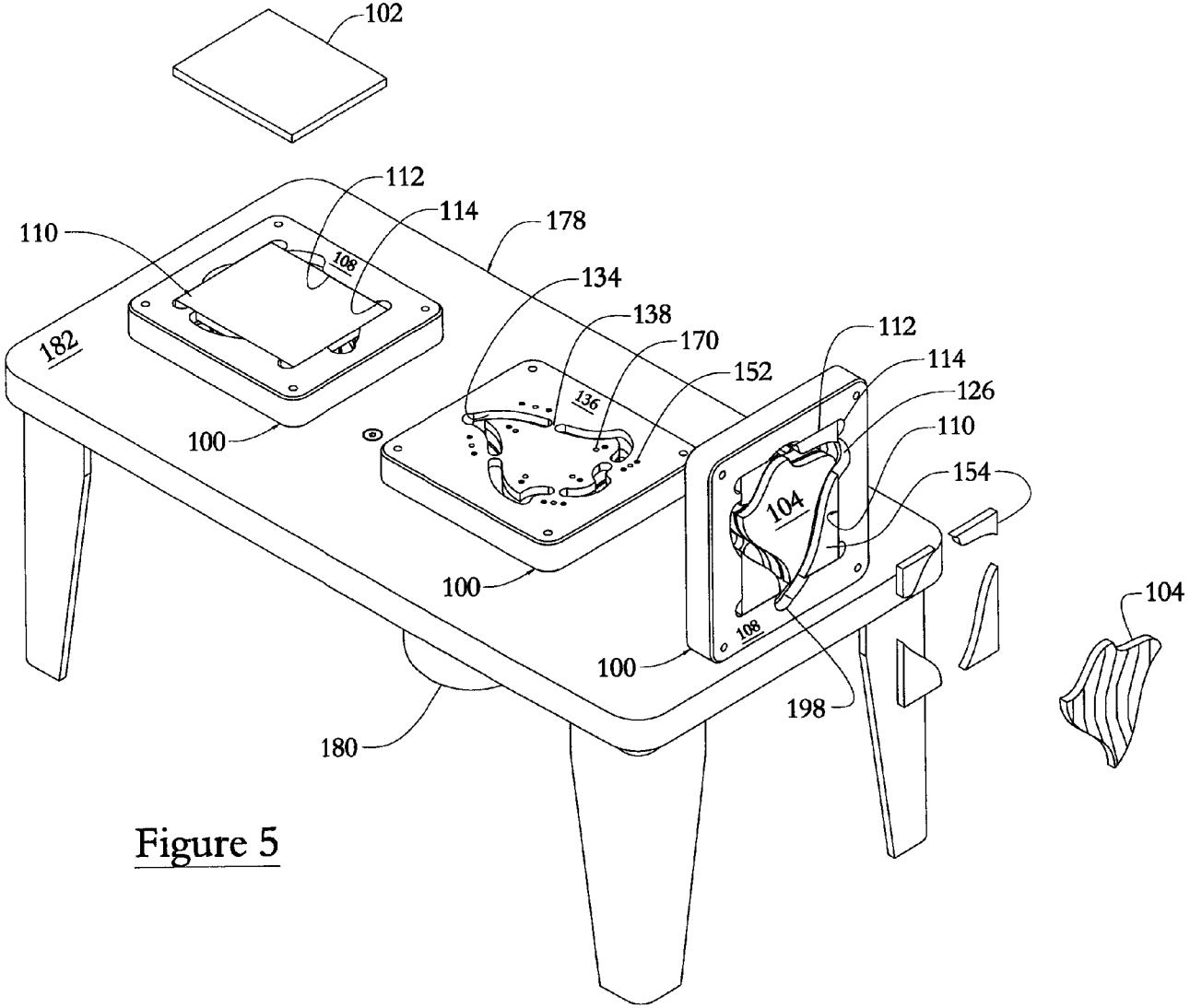
FIG. 5 is a perspective view of the router template of FIG. 1, illustrated in cooperation with a router table and providing an overview of steps involved in a cutting operation associated therewith.

With reference now to FIG. 5, a brief overview of the cutting process is illustrated. Specifically, a conventional router table 178 is illustrated including a conventional router 180 affixed underneath a table surface 182 of the router table 178. A router bit or cutter can be mounted in the router 180 for extending through the table surface 182 for performing the cutting operation.

Initially, a workpiece 102 is provided that is cut to the dimensions of the workpiece nest 112. The gauge plate 172 may be utilized for assisting and providing the workpiece 102 or a plurality of workpieces 102. Subsequently, the workpiece 102 is inserted into the workpiece nest 112. A mallet may be utilized for pressing the workpiece 102 upon the retaining pins 142. The router template bottom surface 108 is subsequently placed upon the table surface 182 for engagement of the router bit with the workpiece 102 within the router template 100. The user may view the woodworking operation through the slots 134. Subsequently, a finished tile 104 and scrap pieces 154 are generated from the workpiece 102 from the woodworking operation. The tile 104 and scrap pieces 154 are then ejected from the router template 100.

Figure 6:
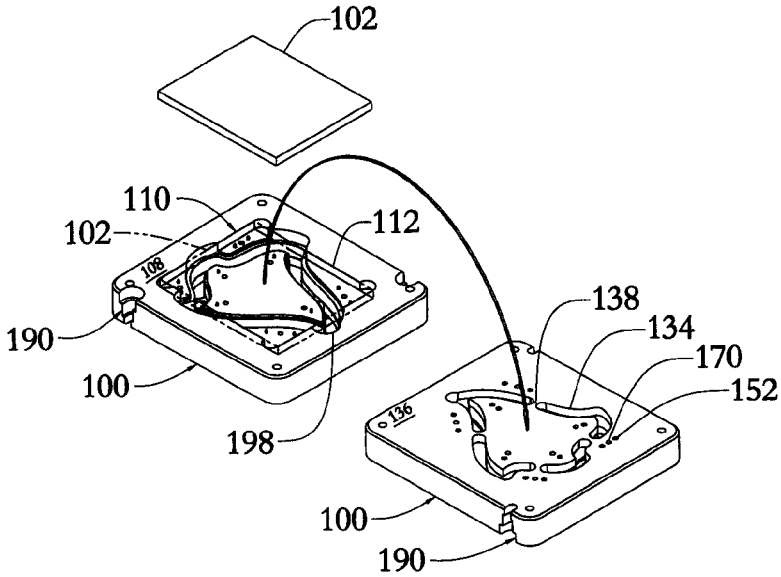
FIG. 6 is a perspective view of the router template and router table of FIG. 5, illustrated in a setup process thereof.
Figure 6:
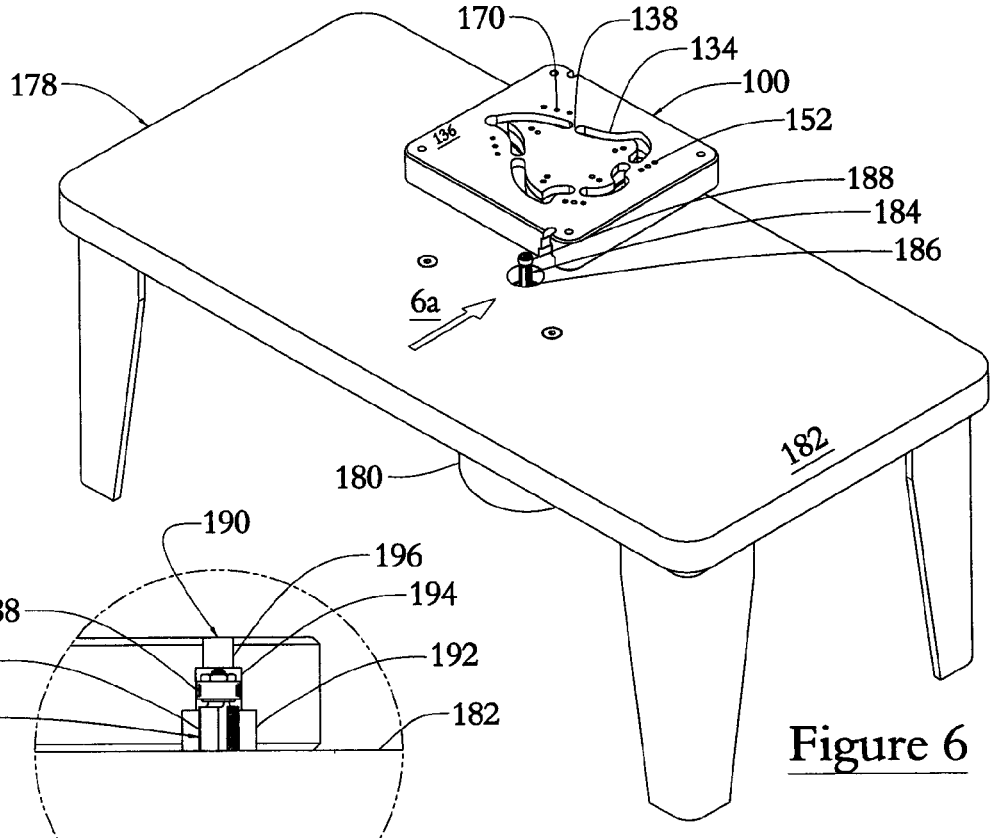
Figure 6A:
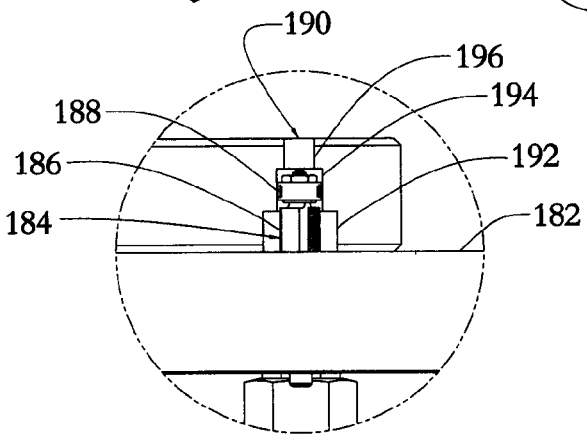
FIG. 6*a* is an enlarged fragmentary side elevation view of a router bit of the router table in FIG. 6, illustrated in cooperation with the router template in FIG. 6, taken along the view arrow 6*a* in FIG. 6.

Referring now to FIG. 6, setup of the router template 100 and router table 178 is illustrated and described. The router table 178 is illustrated with a router bit 184 extending through the table surface 182 from the router 180. Referring to FIG. 6*a*, the router bit 184 includes fluted side cutter 186 with a guide bearing 188 fastened at a distal end thereof.

Referring to FIGS. 6 and 6*a*, the router template 100 includes a router bit setup gauge 190 formed on a lateral side. Specifically, the router template 100 includes a pair of router bit setup gauges 190. Each router bit setup gauge includes a cutter path region 192, a bearing path region 194 and a window slot region 196. Each cutter path region 192, bearing path region 194 and window slot region 196 have a width and height sized to represent the respective cutter path 118, bearing path 126 and window slots 134. The setup gauge 190 permits the user to view the height of the router bit 184 for adjusting the height and aligning the guide bearing 188 within the bearing path region 194 and subsequently the bearing path 126. Concurrently, it permits the user to view and adjust the height of the side cutter 186 relative to the cutter path region 192 and respective cutter path 118.

Referring again to FIG. 6, the workpiece 102 is inserted into the router template 100 and the router template is oriented so that the bottom surface 108 will engage the table surface 182.

Figure 7:
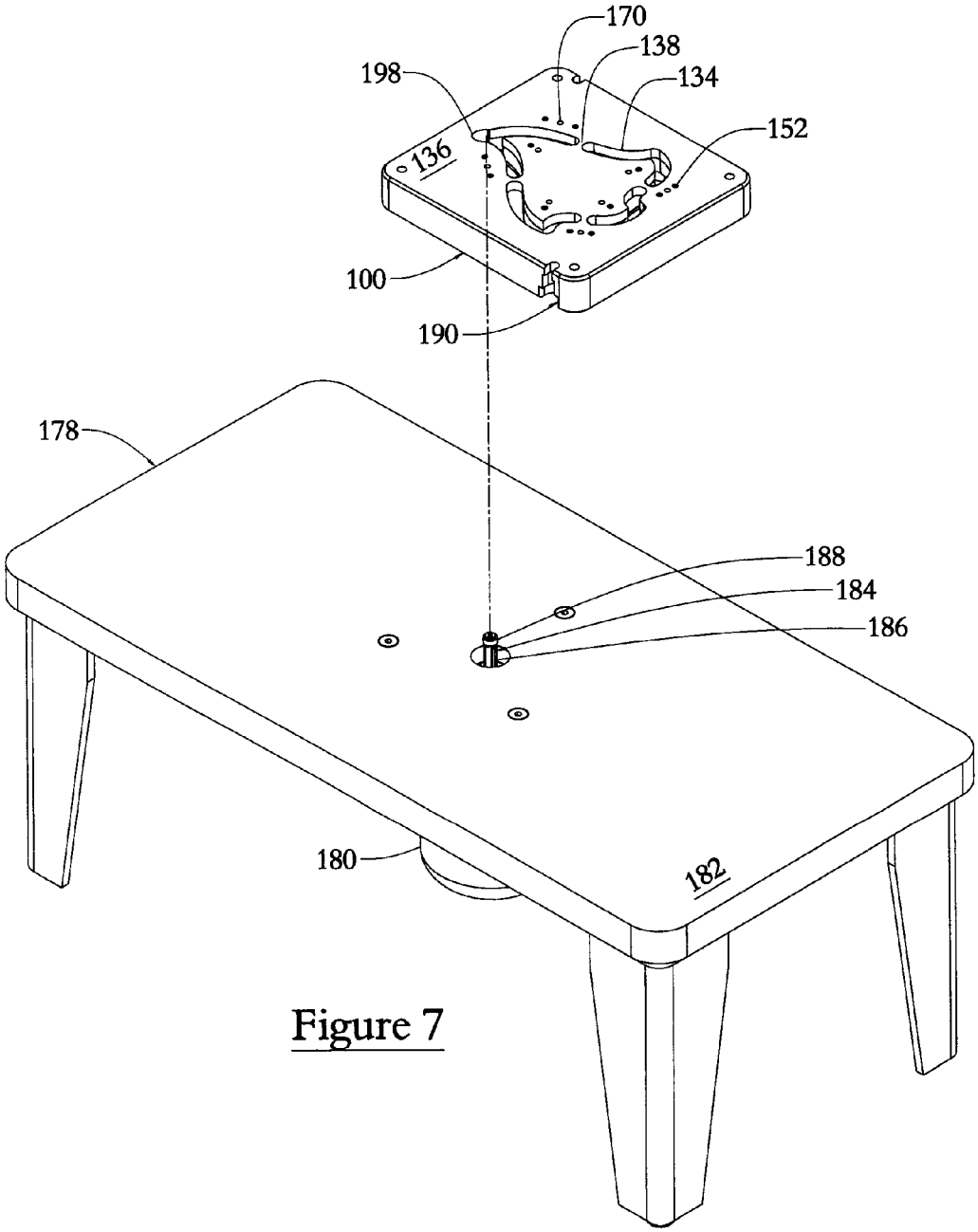
FIG. 7 is a perspective view of the router template and router table of FIG. 5, illustrated in a step of the cutting operation.
Figure 8A:
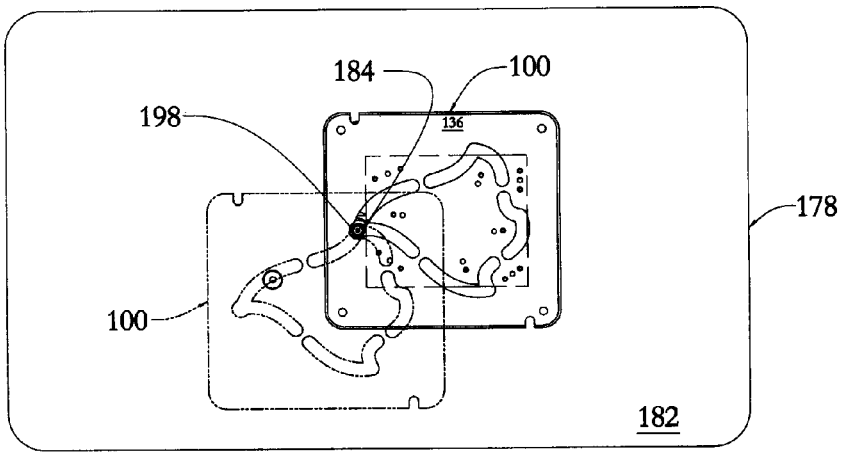
FIG. 8*a* is a top plan view of the router template and router table of FIG. 5 illustrated during the cutting operation.

Referring now to FIGS. 7 and 8*a*, a starting region 198 of the cutter path 118 and bearing path 126 is aligned with the router bit 184; and the router template 100 is placed upon the table surface 182 with the router bit 184 received within the starting region 198. The starting region 198 is oriented outside the perimeter of the workpiece 102 for a startup position of the cutting operation. Upon placement of the router template 100 on the table surface 182 at the starting position illustrated in FIG. 8*a*, the router may be turned on thereby providing a high speed rotation to the router bit.

Figure 8B:
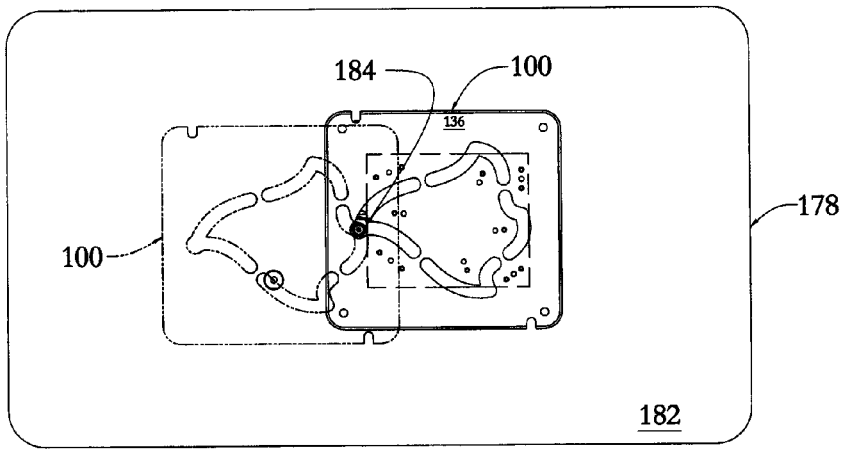
FIG. 8*b* is a top plan view of the router template and router table of FIG. 5, illustrated during the cutting operation.
Figure 8C:
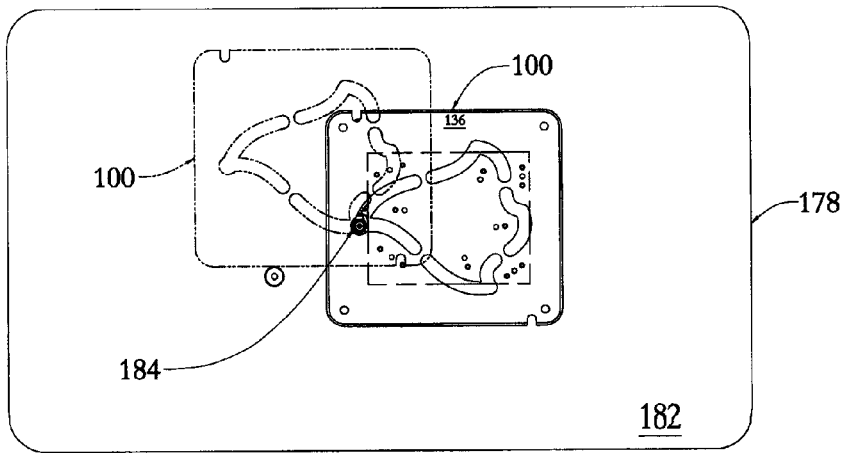
FIG. 8*c* is a top plan view of the router template and router table of FIG. 5, illustrated during the cutting operation.

Subsequently, the user guides the router template 100 so that the guide bearing 188 engages the bearing path 126 at the inboard bearing path region 128 and follows the path around its perimeter as the side cutter 186 cuts the tile 104. For example, the user guides the router template 100 from the starting position, illustrated in solid in FIG. 8*a*, to a subsequent lateral peak of the tile 104 as illustrated in the router template 100 position in phantom in FIG. 8*a*. Then, the user translates the router template 100 upon the table surface 182 to a peak that longitudinally opposes the starting point, as illustrated in phantom in FIG. 8*b*. Subsequently, the user guides the router template 100 to another lateral peak as illustrated in FIG. 8*c*; and finally the user translates the router template 100 back to the starting position as illustrated in solid in FIGS. 8*a* to 8*c*.

FIG. 9 partially illustrates a side elevation view of the router table 178 in cooperation with the router template 100, which is illustrated in section view during the cutting operation. The user may guide the router template 100 manually by hand by grasping the router template 100. Alternatively, handles may be affixed to the router template 100 to assist guiding of the router template 100 during the cutting operation. The window slots 134 are sized and the webs 138 are oriented such that the scrap pieces 154 may not exit through the window slots 134 to avoid inadvertent ejection of the scrap pieces 154 or the workpiece 102 or the finished tile 104. A transparent cover (not shown) can be added to eliminate inadvertent ejection of small scrap pieces and assist in increasing vacuum capacity.

Figure 10:
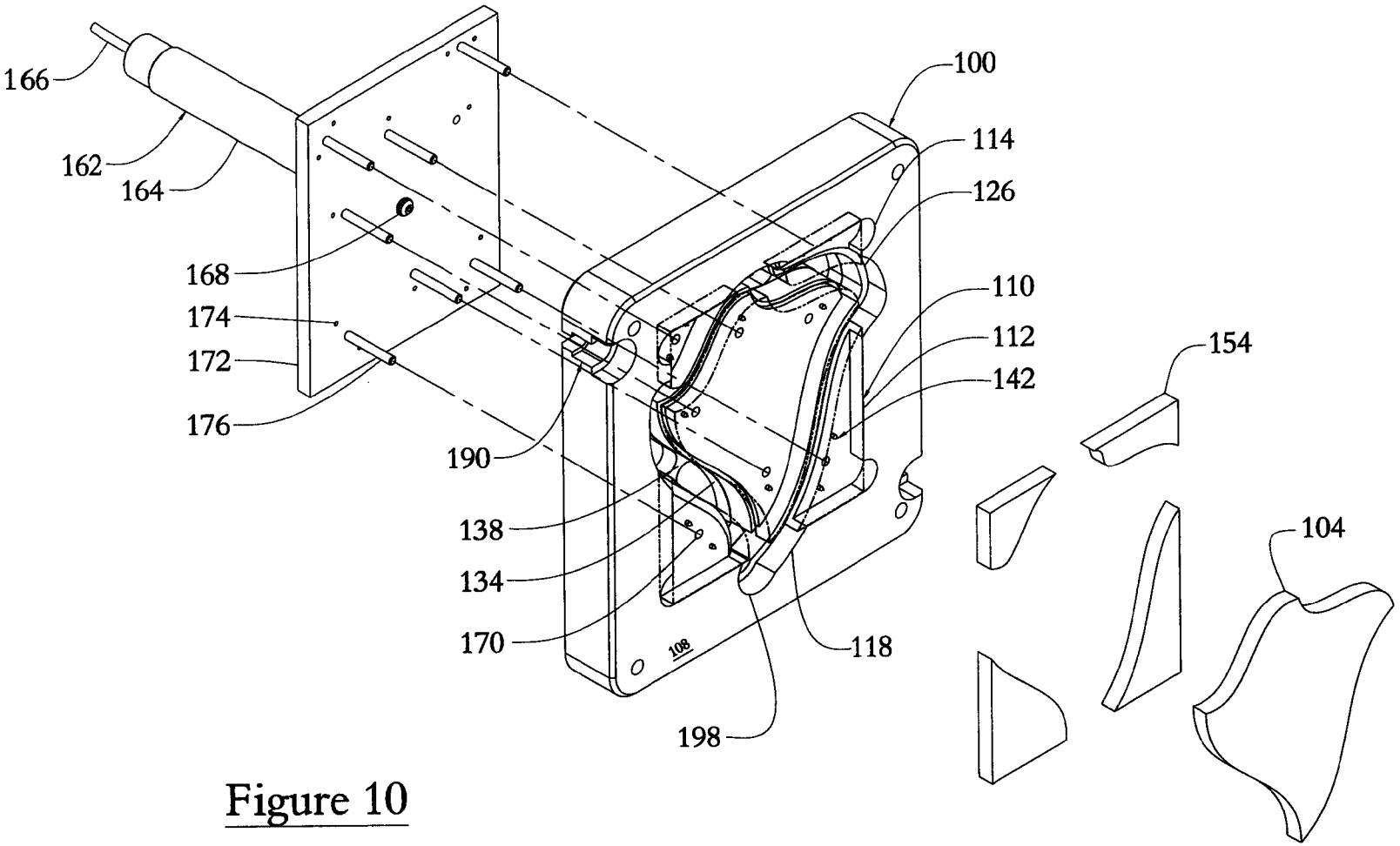
FIG. 10 is a perspective view of the router template of FIG. 1, illustrated in cooperation with the hand tool of FIG. 4, during an ejection process of the tile and associated scrap pieces.
Figure 11:
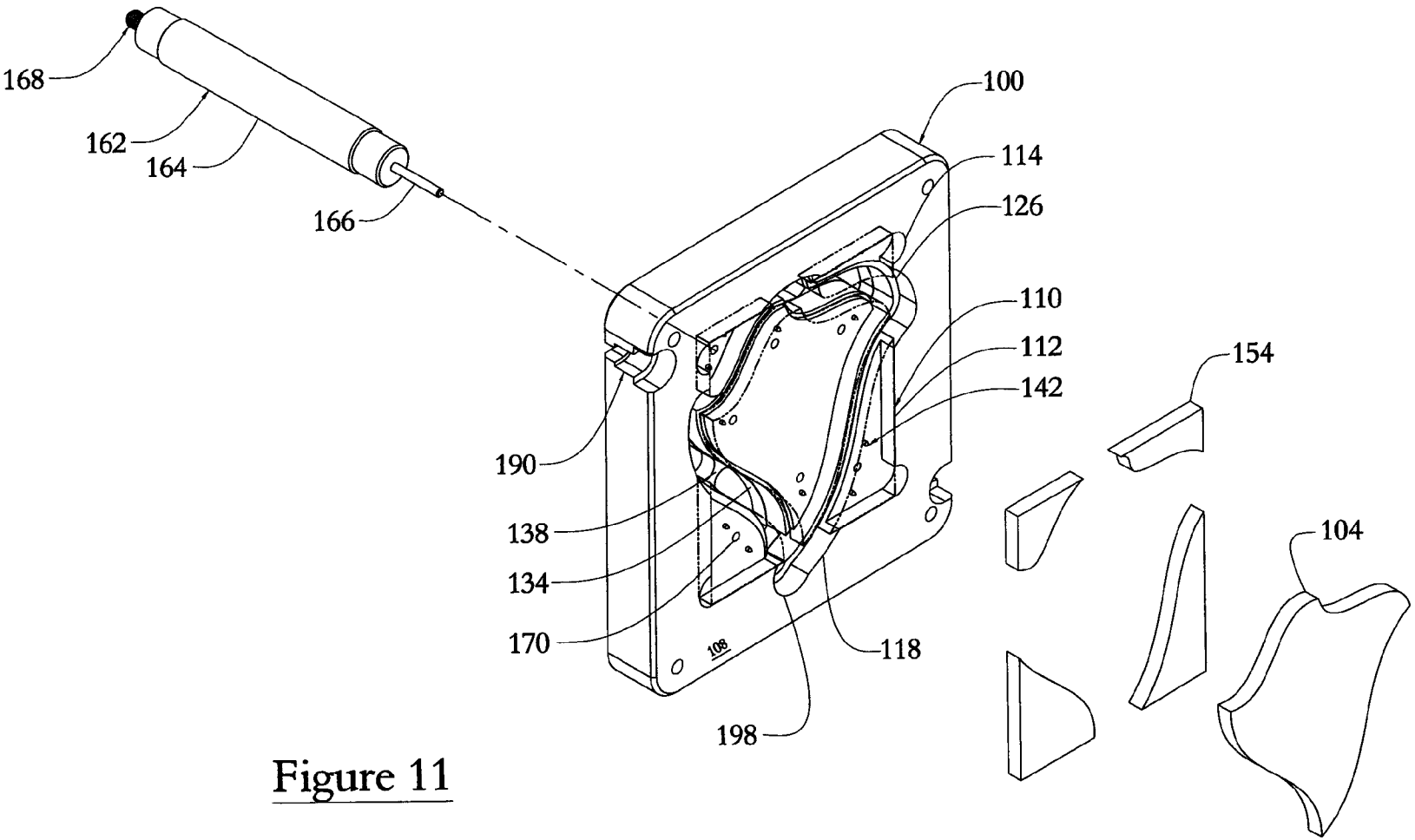
FIG. 11 is a perspective view of the router template of FIG. 1 illustrated in cooperation with the hand tool of FIG. 4, illustrating another ejection process of the tile and the scrap pieces.

Upon completion of the cutting process, the finished tile 104 and the scrap pieces 154 are ejected from the router template 100. Referring to FIG. 10, the hand tool 162 is illustrated ejecting the tile 104 and scrap pieces 154 in one ejection motion by utilizing the ejection pins 176 extending from the gauge plate 172. Alternatively, the tile 104 and scrap pieces 154 may be ejected individually by use of the ejection pin 166 of the hand tool 162 as illustrated in FIG. 11. Manually actuated, spring-return ejection pins can be built into the template housing eliminating external ejection tools.

Figure 12:
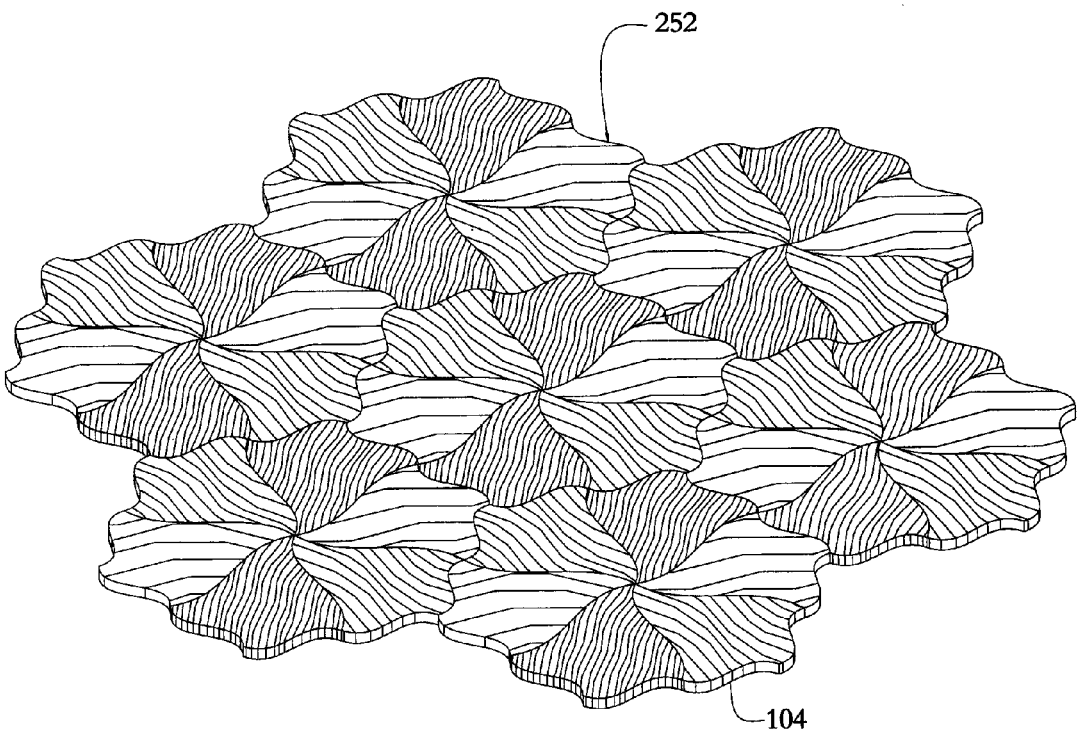
FIG. 12 is a perspective view of a tile pattern created from the router template of FIG. 1.

The tile 104 is a component in a tessellation. This tessellation is illustrated as a finite tessellation in FIG. 12. The tessellation is a single component tessellation where the pattern may be assembled from a plurality of tiles 104, collectively requiring only one tile shape. Accordingly, the tiles 104 may be cut from various woods or various grains to add to the aesthetic effect of the tessellation. Additionally, the tiles 104 may be stained or colored otherwise by various colors or shades to enhance the aesthetic effect. The router template 100 produces tiles 104 that are accurate and repeatable such that when assembled, as illustrated in FIG. 12, that gaps between adjacent tiles 104 are minimal or visually undetectable thereby eliminating a tedious requirement of filling the gaps as required in many prior art tile patterns and methods.

The router template bearing path 126 is a precision spline that is machined to exacting machine tool tolerances (plus or minus 0.0002 inches) and provides a nearly net repeatable shape, which is smaller than a human can see or feel. Given the tolerance play in commercial router bearings and the expansion and contraction of cutting media such as wood, a resultant tile gap tolerance of 0.001 repeatability is obtained between consecutively cut pieces. This 0.001 tolerance allows an average woodworker to assemble a pattern with no noticeable gaps between tiles during assembly. Once the tiles are secured to a stable engineered plate and sealed top and bottom, the thin pattern thickness, and relative contiguous exacting position relative to one another minimizes the effects of expansion and contraction, much greater than conventional methods. The methods for assembly fall into a new category of precision engineered laminates. They are more stable than solid woods and more precise than engineered laminate methods used conventionally.

A user can butt two pieces of straight planed boards together and get an excellent mating surface. But to create a free form shape using conventional woodworking tools, (such as a CNC router built for wood) it is difficult to mate the tessellation with a precision contiguous edge.

What is claimed is:

1. In combination, a table top router and a router template for moving a workpiece on the table top router as the workpiece is cut to form a contoured tile, the router has a bit that includes a cutter assembled coaxially with a bearing, the template is utilized to cut contoured tiles of a desired shape, the router and template combination comprising:

a cutter path layer defining a platen of a nest that receives the workpiece;

a plurality of pins assembled to the platen that extend from the platen in predetermined locations and are received in the workpiece to retain the workpiece on the platen as the workpiece is cut;

a bearing path layer defining a bearing path against which the bearing of the router bit is held as the cutter cuts the workpiece to form the contoured tile that is cut as the bearing follows the bearing path; and a top layer that extends laterally outboard from the bearing path.

2. The combination of claim 1 wherein the pins have a base that is secured in openings in the platen in a range of locations to set the extent to which the pins are received in the workpiece.

3. The combination of claim 1 wherein a window portion is provided in the top layer that permits visual observation of the cutter and workpiece as the workpiece is cut.

4. The combination of claim 1 further comprising a base layer that has a sliding surface which engages a table of the table top router, wherein the platen is recessed relative to the sliding surface and the sliding surface is spaced outwardly from the bearing path to provide clearance for the cutter.

* * * * *